US006182308B1

(12) United States Patent
Yang

(10) Patent No.: US 6,182,308 B1
(45) Date of Patent: Feb. 6, 2001

(54) PLAYPEN WITH DETACHABLE COT

(76) Inventor: Chih-Huang Yang, 7F-1, No. 97, Sec. 2, Chung-Kang Rd., Taichung City (TW)

( * ) Notice: Under 35 U.S.C. 154(b), the term of this patent shall be extended for 0 days.

(21) Appl. No.: 09/542,542

(22) Filed: Apr. 3, 2000

Related U.S. Application Data

(63) Continuation-in-part of application No. 09/407,407, filed on Sep. 29, 1999, now Pat. No. 6,058,528, and a continuation-in-part of application No. 09/264,662, filed on Mar. 8, 1999, now Pat. No. 6,076,205.

(51) Int. Cl.[7] ..... A47D 7/00
(52) U.S. Cl. ..... 5/93.1; 24/616
(58) Field of Search ..... 5/93.1, 93.2, 98.1, 5/99.1, 94, 95, 98.3; 24/616

(56) References Cited

U.S. PATENT DOCUMENTS 3,848,277 * 11/1974 Regiutti ..... 5/93.1
5,163,191 * 11/1992 Chan ..... 5/99.1
5,339,470 * 8/1994 Smamie ..... 5/93.2
5,778,465 * 7/1998 Myers ..... 5/99.1
5,867,850 * 2/1999 Mariol ..... 5/93.2
5,963,996 * 10/1999 Hsia ..... 5/93.1
6,058,528 5/2000 Yang ..... 5/93.1

* cited by examiner

*Primary Examiner*—Alexander Grosz
(74) *Attorney, Agent, or Firm*—Brinks Hofer Gilson & Lione

(57) ABSTRACT

A playpen includes a looped upper frame disposed above and spaced apart from a looped lower frame in a vertical direction. A plurality of vertical post units bridge the upper and lower frames. A cot has a bottom wall and a surrounding wall that is connected to a periphery of the bottom wall and that extends upwardly from the bottom wall. The surrounding wall has a length in the vertical direction which is shorter than a distance between the upper and lower frames in the vertical direction. The surrounding wall further has a distal top portion formed with a plurality of outwardly folded sections that engage removably the upper frame for suspending the cot thereon such that the bottom wall is disposed above the lower frame. A releasable fastening unit includes a plurality of complementary male and female fastener sets secured on the outwardly folded sections in such a manner that each adjacent pair of fasteners of the male and female fastener sets extends into a respective one of the notches, thereby confining the post units in the notches, respectively.

3 Claims, 5 Drawing Sheets

PLAYPEN WITH DETACHABLE COT

CROSS-REFERENCE TO RELATED APPLICATION

This application is a Continuation-in-Part of U.S. patent application Ser. No. 09/407,407, which was filed on Sep. 29, 1999, now U.S. Pat. No. 6,058,528, and is a continuation-in-part of application Ser. No. 09/264,662 filed on Mar. 8, 1999, now U.S. Pat. No. 6,076,205.

FIELD OF THE INVENTION

The invention relates to a playpen, more particularly to a playpen with a detachable cot.

BACKGROUND OF THE INVENTION

Referring to FIGS. 1 and 2, in co-pending U.S. patent application Ser. No. 09/407,407, now U.S. Pat. No. 6,058,528, filled by the applicant, a playpen is shown to include a looped lower frame 13, a looped upper frame 12, a plurality of vertical posts 15, a cot 20 and a releasable fastening unit.

As illustrated, the upper frame 12 is disposed above and is spaced apart from the lower frame 13 in a vertical direction. The vertical posts 15 bridge the upper and lower frames 12,13.

The cot 20 has a bottom wall 21 made from a cushioning material and a surrounding wall 22 formed from a fabric material. The surrounding wall 22 is connected to a periphery of the bottom wall 21 and extends upwardly from the bottom wall 21. The surrounding wall 22 has a length in the vertical direction which is shorter than a distance between the upper and lower frames 12,13 in the vertical direction. The surrounding wall 22 further has a distal top portion 220 that engages the upper frame 12 for suspending the cot 20 thereon, as best shown in FIG. 1, such that the bottom wall 21 is disposed above the lower frame 13. The distal top portion 220 of the surrounding wall 22 further has an outwardly folded section 222 defining a looped receiving groove 223 that opens downward for receiving removably the upper frame 12 therein. The outwardly folded section 222 is provided with a plurality of notches 221 that are registered with the vertical posts 15, respectively.

The releasable fastener unit includes a plurality of complementary male and female fastener sets 23,16. The female fastener sets 16 are secured to the vertical posts 15, while the male fastener sets 23 are secured to the outwardly folded section 222 and extend into the notches 221 such that each fastener 160 of the female fastener sets 16 is disposed between a pair of fasteners 230 of the male fastener sets 23. Each of the fasteners 230, 160 of the male and female fastener sets (23,16) is formed with a coupling ring (233, 165). Each of the vertical posts 15 is provided with an anchoring strap 167 that is connected to the coupling ring 165 of a respective one of the fasteners 160 of the female fastener sets 16. Each of the fasteners 160 of the female fastener sets 16 includes a hollow fastener body 161 with two opposite open insert ends 162, and a confining wall 163 that is formed with opposite engaging slots 164. Each of the fasteners 230 of the male fastener sets 23 has an insert portion 232 that is extended into the hollow fastener body 161 of a corresponding one of the fasteners 160 of the female fastener sets 16 via the open insert end 162 and that is formed with resilient projections 2321 for engaging releasably the engaging slots 164 in the hollow fastener body 161 of the corresponding one of the fasteners 160 of the female fastener sets 16.

Some of the drawbacks that result from the use of the aforesaid playpen are as follows:

(i) The resilient projections 2321 in each of the fasteners 230 are pressed by the user toward each other in order to remove the same from the engaging slots 164 of the fastener 160, which subsequently, can cause pain to the user's fingers.

(ii) The fasteners 160 are fastened to an enclosure 11 via the coupling ring 165 and the anchoring straps 167. It is noted that the enclosure 11 may easily tear due to the weight of the baby disposed in the cot 20. Thus, the service life of the aforesaid playpen is relatively short.

SUMMARY OF THE INVENTION

Therefore, the object of this invention is to provide a playpen which has a detachable cot that is capable of overcoming the aforesaid drawbacks.

Accordingly, the playpen of this invention includes a looped lower frame, a looped upper frame disposed above and spaced apart from the lower frame in a vertical direction, a plurality of vertical post units, a cot, and a releasable fastening unit. The vertical post units bridge the upper and lower frames. The cot has a bottom wall and a surrounding wall that is connected to a periphery of the bottom wall and that extends upwardly from the bottom wall. The surrounding wall has a length in the vertical direction which is shorter than a distance between the upper and lower frames in the vertical direction. The surrounding wall further has a distal top portion formed with a plurality of outwardly folded sections that engage removably the upper frame for suspending the cot thereon such that the bottom wall is disposed above the lower frame. The distal top portion of the surrounding wall further has a plurality of notches, each of which is disposed between adjacent two of the outwardly folded sections. Each of the post units extends into a respective one of the notches. The releasable fastening unit includes a plurality of complementary male and female fastener sets secured on the outwardly folded sections in such a manner that each adjacent pair of fasteners of the male and female fastener sets extends into the respective one of the notches, thereby confining the post units in the notches, respectively.

Preferably, each of the fasteners of the female fastener set includes a hollow fastener body with an open insert end, a confining wall that is formed with opposite engaging slots in communication with the insert end, and a pair of resilient press members which are integrally formed with the confining wall and which flank the engaging slots. Each of the fasteners of the male fastener set has an insert portion that is extendible into the hollow fastener body via the open insert end and that is formed with resilient projections for engaging releasably the engaging slots. Pressing of the press members toward each other results in movement of the resilient projections toward each other so as to disengage the same from the engaging slots.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
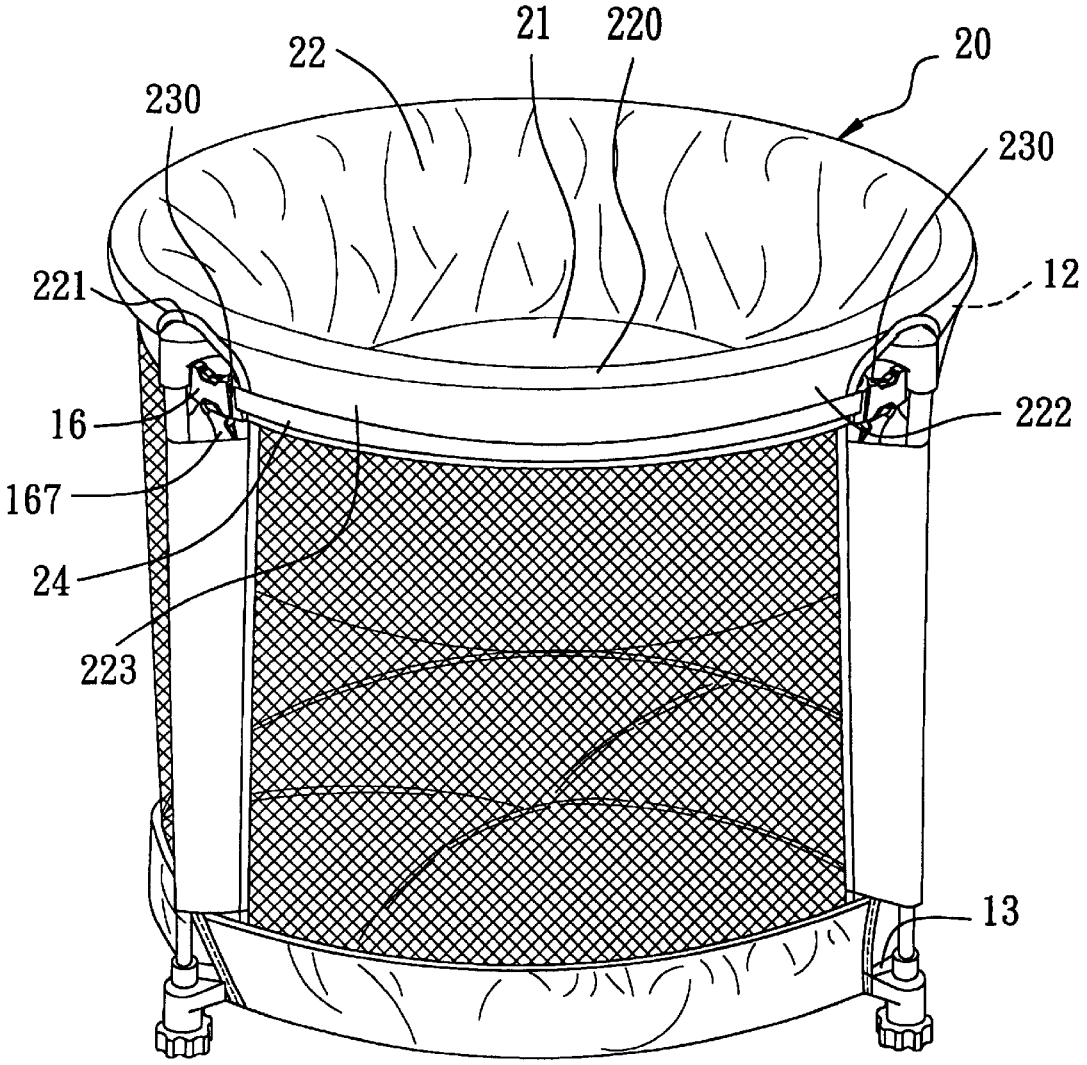
FIG. 1 is a perspective view of a playpen disclosed in U.S. patent application Ser. No. 09/407,407 now U.S. Pat. No. 6,058,528.
Figure 2:
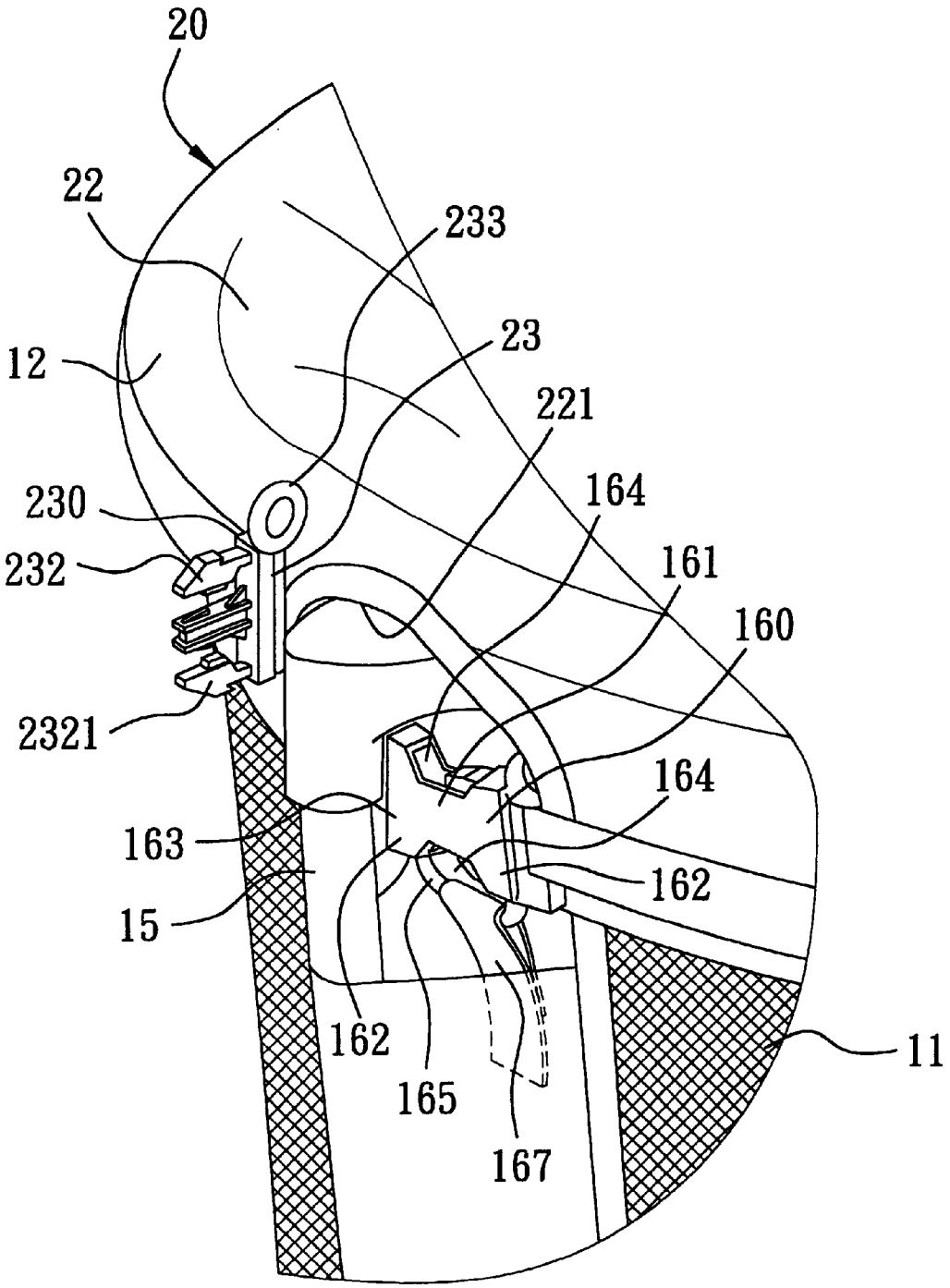
FIG. 2 is an enlarged fragmentary perspective view of the playpen shown in FIG. 1.
Figure 3:
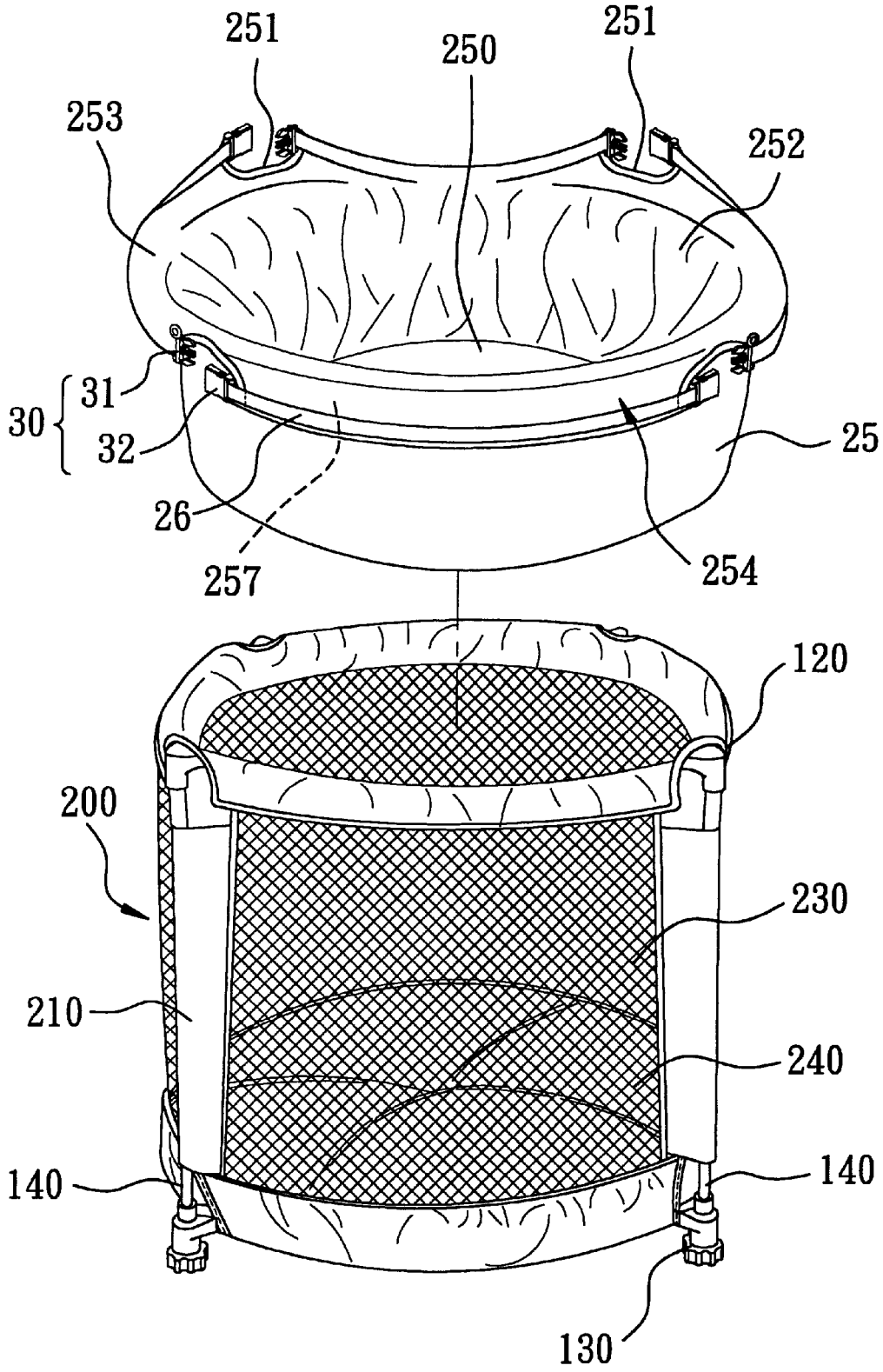
FIG. 3 is a partly exploded view of the preferred embodiment of a playpen of the present invention.
Figure 4:
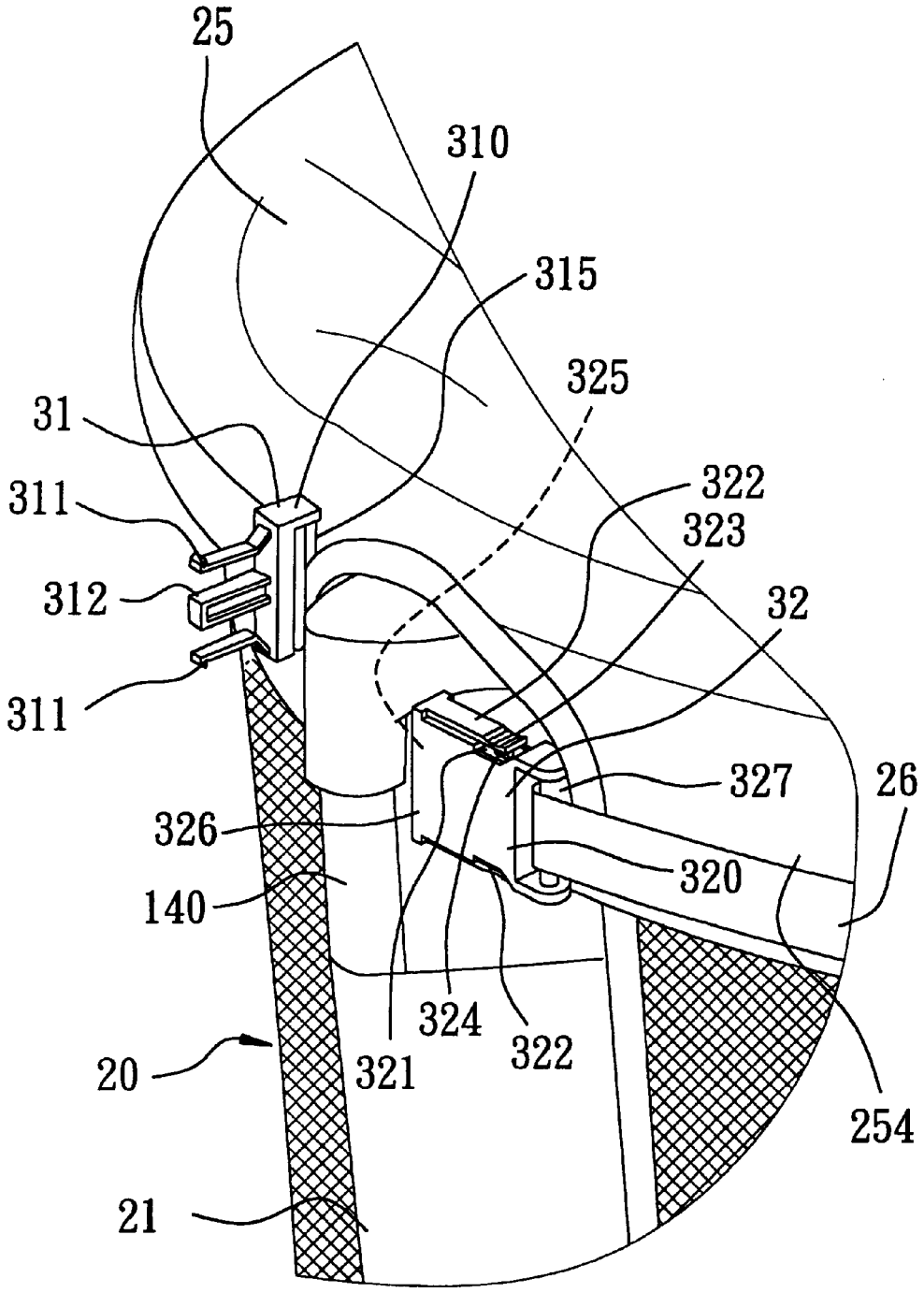
FIG. 4 is an enlarged fragmentary perspective view of the preferred embodiment, illustrating how a releasable fastening unit fastens a cot on a vertical post unit.
Figure 5:
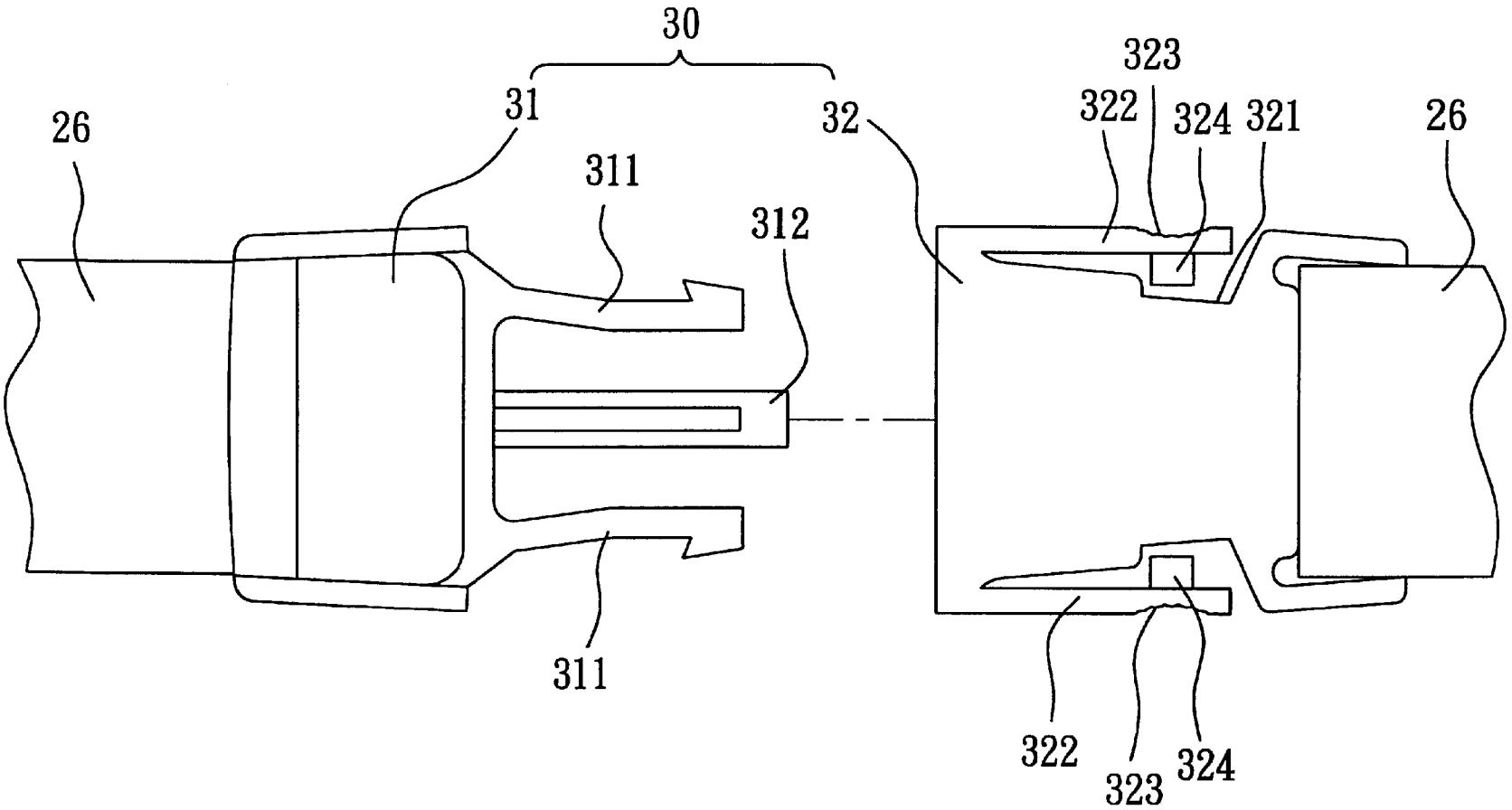
FIG. 5 is an enlarged view of the releasable fastening unit employed in the preferred embodiment.

Referring to FIGS. 3, 4 and 5, the preferred embodiment of a playpen 200 according to this invention is shown to include a looped lower frame 130, a looped upper frame 120, a plurality of vertical post units 140, a cot 25, and a releasable fastening unit 30.

As illustrated, the upper frame member 120 is disposed above and is spaced apart from the lower frame 130 in a vertical direction.

The vertical post units 140 bridge the upper and lower frames 120, 130.

The cot 25 has a bottom wall 250 made from a cushioning material and a surrounding wall 252 formed from a fabric material. The surrounding wall 252 is connected to a periphery of the bottom wall 250 and extends upwardly from the bottom wall 250. The surrounding wall 252 has a length in the vertical direction which is shorter than a distance between the upper and lower frames 120,130 in the vertical direction. The surrounding wall 252 has a distal top portion 253 formed with a plurality of outwardly folded sections 254 defining a looped receiving groove 257 that opens downward for receiving removably the upper frame 120 therein so as to suspend the cot 25 on the upper frame 120 such that the bottom wall 250 is disposed above the lower frame 130. The distal top portion 253 is further provided with a plurality of notches 251, through which, the vertical post units 140 extend, respectively.

The releasable fastening unit 30 includes a plurality of complementary male and female fastener sets 31,32 for fastening releasably the cot 25 on the upper frame 120.

In the preferred embodiment, the male and female fastener sets 31,32 are secured on the outwardly folded sections 254 in such a manner that each adjacent pair of fasteners of the male and female sets 31,32 extends into a respective one of the notches 251. In this way, the post units 140 are confined in the notches 251 of the outwardly folded sections 254.

Preferably, each of the fasteners 320 of the female fastener sets 32 includes a hollow fastener body with an open insert end 325 and a strap coupling end 327, a confining wall 326 that is formed with opposite engaging slots 321 in communication with the insert end 325, and a pair of resilient press members 322 integrally formed with the confining wall 326 and flanking the engaging slots 321. Each of the fasteners 310 of the male fastener sets 31 has a strap coupling portion 315 and an insert portion 312 that is extendible into the hollow fastener body via the open insert end 325 and that is formed with two resilient projections 311 for engaging releasably the engaging slots 321 of the fastener 320. Each of the press members 322 has an outer surface provided with a knurled portion 323, and an inner surface formed with a stud 324 that is registered with a corresponding one of the resilient projections 311.

When it is desired to release the fasteners 310,320 from each other, the press members 322 of the fastener 320 are pressed toward each other, which in turn, results in movement of the resilient projections 311 toward each other so as to disengage the projections 311 from the engaging slots 321 of the fastener 320.

In the preferred embodiment, the cot 25 further has a plurality of fastener bands 26. Each of the bands 26 is secured to one of the outwardly folded sections 254 and extends between an adjacent pair of the notches 251. Each of the bands 26 has opposite ends fixed on the coupling portions 310,327 of the fasteners 310,320 such that the bands 26 ensure tight engagement between the distal top portion 253 of the surrounding wall 252 and the upper frame 120 when the male and female fastener sets (23,16) are interengaged.

As to the construction of the upper and lower frames 120,130 and the post units 140, a detailed description of the same can be found in the aforesaid co-pending U.S. patent application, the entire disclosure of which is incorporated therein by reference.

A flexible enclosure 230, which has a depth in the vertical direction greater than that of the cot 25, is mounted on the upper and lower frames 120,130 and the vertical post units 140 in such a manner that the enclosure 230 is disposed around the cot 25. The enclosure 230 has an annular wall with an open top, and a bottom support 240 mounted on and supported by the lower frame 130 inside the enclosure 230. The enclosure 230 further has a plurality of upright retention sleeves 210 on an outer circumferential surface of the annular wall to permit passage of the upright post units 140 therethrough such that the annular wall is prevented from shrinking inwardly relative to the upper and lower frames 120,130.

When the playpen of this invention is used to accommodate a small child, the cot 25 is installed to facilitate putting and taking of the child from the playpen. When the child has outgrown the cot 25, the cot 25 can be removed from the upper frame 120 so that the child can play in the enclosure 230.

With this invention thus explained, it is apparent that numerous modifications and variations can be made without departing from the scope and spirit of this invention. It is therefore intended that this invention be limited only as indicated in the appended claims.

I claim:

1. A playpen comprising:

a looped lower frame;

a looped upper frame disposed above and spaced apart from said lower frame in a vertical direction;

a plurality of vertical post units bridging said upper and lower frames;

a cot having a bottom wall and a surrounding wall that is connected to a periphery of said bottom wall and that extends upwardly from said bottom wall, said surrounding wall having a length in the vertical direction which is shorter than a distance between said upper and lower frames in the vertical direction, said surrounding wall further having a distal top portion formed with a plurality of outwardly folded sections that engage removably said upper frame for suspending said cot thereon such that said bottom wall is disposed above said lower frame, said distal top portion of said surrounding wall further having a plurality of notches, each of which is disposed between adjacent two of said outwardly folded sections, each of said post units extending into said notches respectively; and a releasable fastening unit for fastening releasably said cot on said vertical posts and said upper frame, said releasable fastening unit including a plurality of complementary male and female fastener sets secured on said outwardly folded sections in such a manner that each adjacent pair of fasteners of said male and female fastener sets extends into a respective one of said notches, thereby confining said post units in said notches, respectively.

2. The playpen as defined in claim 1, wherein:

each of said fasteners of said female fastener set includes a hollow fastener body with an open insert end, a confining wall that is formed with opposite engaging slots in communication with said insert end, and a pair of resilient press members integrally formed with said confining wall and flanking said engaging slots; and each of said fasteners of said male fastener set has an insert portion that is extendible into said hollow fastener body via said open insert end and that is formed with resilient projections for engaging releasably said engaging slots;

whereby, pressing of said press members toward each other results in movement of said resilient projections toward each other so as to disengage from said engaging slots.

3. The playpen as defined in claim 2, wherein each of said press members has an outer surface provided with a knurled portion, and an inner surface formed with a stud that is registered with a corresponding one of said resilient projections.

* * * * *

UNITED STATES PATENT AND TRADEMARK OFFICE

CERTIFICATE OF CORRECTION

PATENT NO. : 6,182,308 B1
DATED : February 6, 2001
INVENTOR(S) : Chih-Huang Yang It is certified that error appears in the above-identified patent and that said Letters Patent is hereby corrected as shown below:

Title page,
Item [63], insert -- issued May 9, 2000. -- after "6,058,528," and delete "and a continuation-in-part of application No. 09/264,662, filed on Mar. 8, 1999, now Pat. No. 6,076,205.".

Signed and Sealed this

Nineteenth Day of February, 2002

*Attest:*

*Attesting Officer*

JAMES E. ROGAN
*Director of the United States Patent and Trademark Office*